United States Patent [19]

Sarkozi

[11] Patent Number: 5,020,174

[45] **Date of Patent: * Jun. 4, 1991**

[54] SELF ADJUSTABLE, NECK SUPPORT PILLOW

[76] Inventor: Jeff Sarkozi, 1117 N. Avila Pl., Orange, Calif. 92669

[ * ] Notice: The portion of the term of this patent subsequent to Sep. 18, 2007 has been disclaimed.

[21] Appl. No.: 573,535

[22] Filed: Aug. 27, 1990

Related U.S. Application Data

[63] Continuation-in-part of Ser. No. 415,873, Oct. 2, 1989, Pat. No. 4,956,886.

[51] Int. Cl.[5] ..... A47G 9/00

[52] U.S. Cl. ..... 5/437; 5/441

[58] Field of Search ..... 5/437, 434, 436, 441

[56] References Cited

U.S. PATENT DOCUMENTS

| | | | |
|---|---|---|---|
| 395,043 | 12/1888 | Doremus | 5/437 |
| 2,765,480 | 10/1956 | Mueller | 5/437 |
| 2,952,856 | 9/1960 | Ruff | 5/437 |
| 4,393,530 | 7/1983 | Stark | 5/437 |
| 4,550,459 | 11/1985 | Endel et al. | 5/437 |

FOREIGN PATENT DOCUMENTS

| | | | |
|---|---|---|---|
| 26072 | of 1909 | United Kingdom | 5/437 |

*Primary Examiner*—Alexander Grosz
*Attorney, Agent, or Firm*—Willie Krawitz

[57] ABSTRACT

A three component, self adjustable pillow is provided to support and align a user's head, and shoulders. The pillow comprises a head support base containing a soft fill such as polyester, nylon, foam, chip foam, etc., and shaped as a round or elliptical, solid cylinder. A cloth attachment piece is connected along one of its sides to the pillow by sewing along the pillow length. A circular-shaped, cylindrical neck support is sewn onto the cloth attachment piece along its remaining free side, and this enables the neck support to rest on the head support base for adjustable movement by the user.

Preferably, the user's shoulders are supported on the head support base and located somewhere between the edge of the support base and the base of the neck support, and usually at the edge of the support base. The soft fill construction of the head support base enables inward forces of compression produced by the user's shoulders to be transmitted into the pillow, and this causes these compressive forces to be directed along the head support base and upwards to the neck support. These upward forces will enhance the support function of the neck support. Since the user's head rests on the portion of the support base beyond the neck support, the overall effect of the adjustable pillow produces both an alignment and support of the user's shoulders, neck and head. This reduces the tendency to stiffness, discomfort, chronic muscle strain, and aching in the neck and shoulder area.

8 Claims, 1 Drawing Sheet

SELF ADJUSTABLE, NECK SUPPORT PILLOW

This application is a continuation-in-part of U.S. patent application Ser. No.: 415,873; filed Oct. 2, 1989 and issued Sept. 18, 1990 as U.S. Pat. No. 4,956,886.

BACKGROUND OF THE INVENTION

This invention relates to a new and improved adjustable pillow support for the shoulders, neck and head of a user. The pillow support is designed to enable the user to purposefully adjust the pillow and attached components to the particular body size required, and enable the shoulders, neck and head of the user to be maintained in a reasonably aligned manner, when the user is lying on the back or side. The pillow also conforms to the user's movements when asleep to apply adequate neck support on a change of sleep position from the side to the back. This in turn reduces stiffness, aching, discomfort, and chronic muscle strain.

Various support devices for a user's shoulders, neck and head have been proposed, and typical prior art devices are shown in U.S. Pat. Nos. 395,043; 2,952,856; 2,765,480; 3,648,308; 4,320,543; 4,393,530; 4,432,107; 4,550,459; 4,754,513; 4,829,614; 4,803,743; and, 4,821,255; and, British Patent 26,072.

None of these prior art devices provide a support which may be purposefully adjusted by moving it along the pillow to conform to the user's size. Also, none of these prior art devices are adapted to provide a self adjusting neck support for the user based on the user's weight and body size. Moreover, none of these support devices are self adjustable along with the user's movements on based on changes of the user's position when asleep, not only in terms of general positioning, but also in terms of vertically accommodating to the alignment of the neck and shoulders.

Consequently, a need exists for an adjustable pillow support which accommodates to a variety of user sizes and sleep positions without requiring too great a diverse inventory. Preferably, such a device should be inexpensive, easy to manufacture and repair, and require little or no training to use. Also, the device should appear aesthetically pleasant, and not stand out from associated furniture.

THE INVENTION

According to the invention, an adjustable three-component pillow support is provided, one component being a base portion having a square or oblong shape, and a generally elliptically, oval, plano convex, etc., shaped cross section, and similar in shape to the usual pillow. The pillow is constructed typically of a cloth exterior, and with a soft fill such as polyester, cotton, nylon, foam, chip foam, etc., to enable forces of compression to be transmitted via the soft fill through the pillow.

The second component of the pillow support comprises a generally rectangularly-shaped cloth attachment piece which is connected to the pillow, typically by sewing, along one of the edges of the attachment piece. This leaves the other edge of the attachment piece free for connection to the third component of the pillow support and which comprises a cylindrical-shaped neck support of considerably smaller dimensions than the base portion. The attachment piece is connected by its free edge to the neck support along the longitudinal portion, and since the attachment piece is relatively wide, it can move over a fairly large area of the pillow along with the neck support. Thus, the neck support is readily adjustable by the user when awake, and self adjusts along with the user's movements when the user is asleep.

DESCRIPTION OF THE PREFERRED EMBODIMENTS

Figure 1:
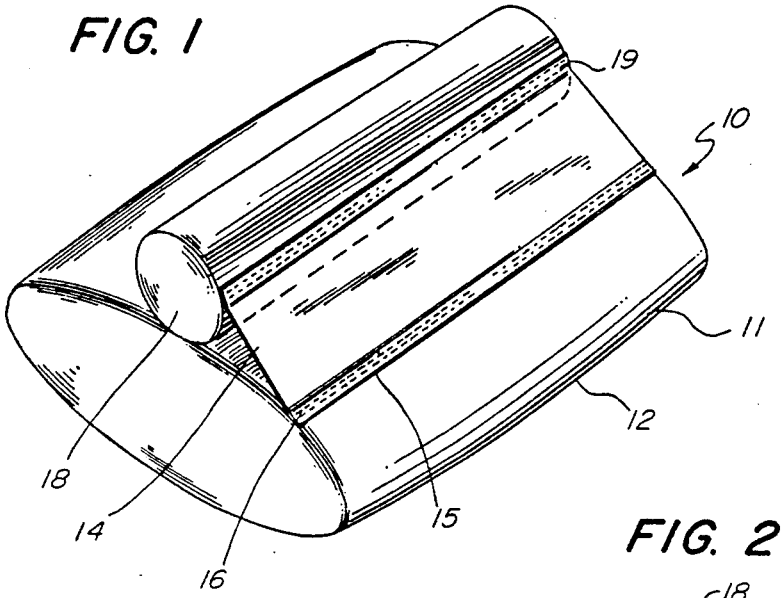
FIG. 1 is an upper, perspective view of the self adjustable neck support pillow, of this invention.
Figure 2:
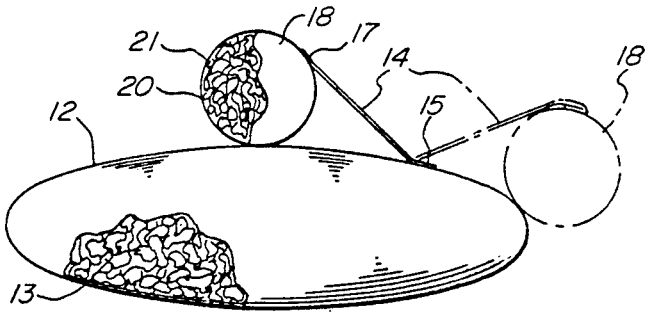
FIG. 2 is an end elevation view of the neck support pillow, partly broken away.

The adjustable neck support pillow 10 of this invention is shown in FIGS. 1 and 2, and comprises a generally cylindrically-shaped pillow base structure 11 having an elliptical, oval, plano convex, or similar cross section. The pillow base structure has an outer cloth covering 12 of woven fabrics such as cotton, polyester, nylon, acrylics, etc., and blends of these materials. The interior of the pillow base structure 11 contains a soft fill 13 to enable inward forces of compression due to the user's shoulders to be transmitted inwardly along the pillow and upwardly to an adjustable neck support, which will be described, infra. A cloth attachment piece 14 with a generally rectangular shape, is connected along the edge 15 usually by sewing stitches 16, to the pillow base structure, about midway between one edge and the center of the base structure 11. The cloth attachment piece 14 is generally constructed of materials similar to the covering of the pillow base structure, i.e., cotton, polyester, nylon, acrylics, and blends of these, etc.

The free edge 17 of the attachment piece is connected to a neck support 18 by sewing stitches 19, the neck support resting on the pillow base structure 11, but being freely movable thereon, to the extent of the width of the cloth attachment piece. The limits of movement are such that the neck support does not extend over the edge of the pillow, and this limit is shown in dotted designation. The neck support is shown in FIG. 2, and is manufactured of the same, or similar materials as the cloth attachment piece and the pillow base structure. Thus, the outer covering 20 of the neck support is usually woven cotton, nylon, polyester, acrylics, and blends of these, etc., and the interior 21 is a soft fill material such as cotton, rice, polyester, nylon, acrylic polymers, fiber fill, loose gauze, down, foam, chip foam, air, liquid, gel, and mixtures of these.

If desired, a heating or cooling means may be incorporated into either the neck support and/or pillow.

Typically, a broad range of dimensions of the pillow base structure 11 is about 12"-30" wide, and about 20"-40" long, the cloth attachment piece 14 is up to about 6" wide, and preferably about 1"-6" wide, and the neck support 18 is about 1"-6" in diameter for adults, and about 1"-4" in diameter for children. A narrower range of dimensions of the pillow base structure 11 is about 12"-18" wide, and about 30"-36" in length, the cloth attachment piece 14 is up to about 5" wide, and preferably about 3"-5" wide, and the neck support 18 is about 2"–4" in diameter for adults, and about 1"–4" in diameter for children.

Figure 3:
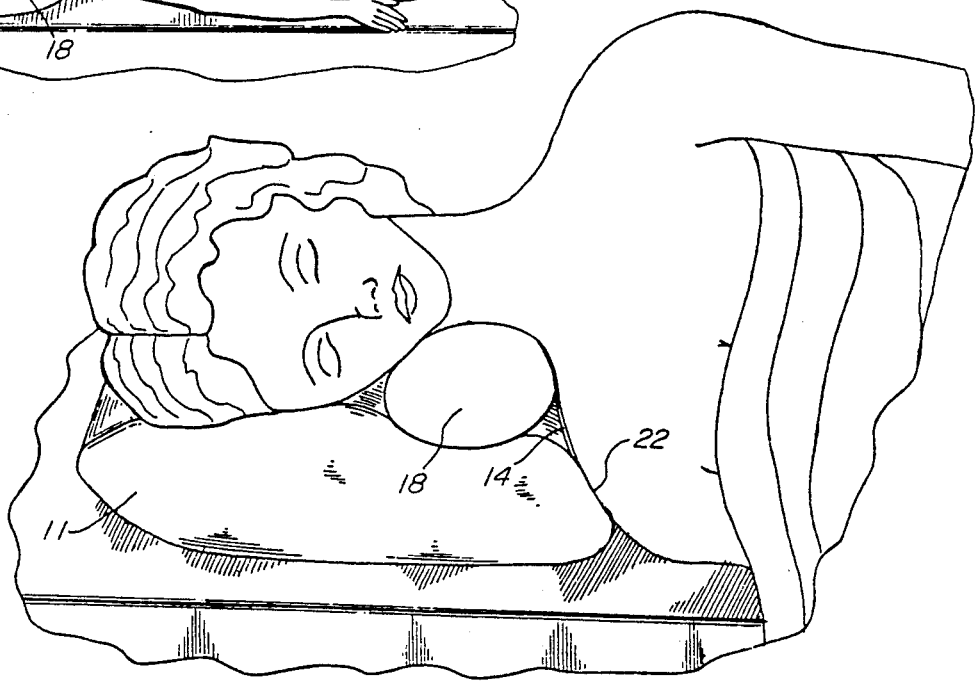
FIG. 3 is an end elevation view of the pillow, supporting a user thereon; and, FIG. 4 is a schematic side elevation view of a user being supported in a supine position on the support pillow of this invention.

As shown in FIG. 3, a person will rest their shoulders and head on the pillow base structure 11, and their neck will be supported by the neck support 18. The person's shoulders produce an inward compression force on the pillow base structure 11, causing the pillow support structure to become compressed inwardly 22. Due to the type of soft fill employed in the pillow base structure, this inward compression will transmit an upward force to the neck support 18. Generally, the person's shoulder weight and size on the pillow will transmit an inward compression force to the neck support roughly equivalent to that necessary for providing adequate support for the neck.

Figure 4:
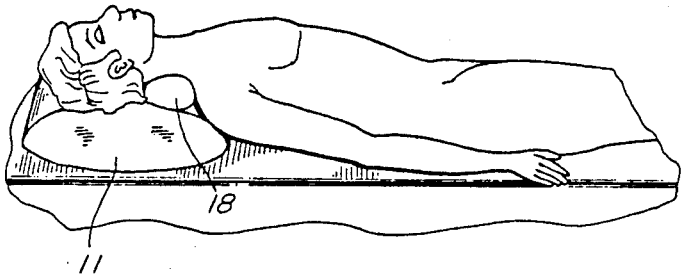

Similarly, as shown in FIG. 4, for a person lying on their back, their shoulders will spread out their weight to a greater extent, compared to lying sideways. Hence, there will be less upward linear movement of the neck support 18, which is desireable for persons in a supine position.

Overall, the head, neck and shoulders of the person resting on the neck support pillow 10 of this invention are reasonably aligned, and this results in less aching, discomfort, stiffness, and muscle strain of the neck muscles. Also, there is less tendency of the lower back to be adversely affected when resting on the support pillow.

If desired, the components of this invention can be manufactured by providing an external cover comprising the neck support 18 and cloth attachment 14 connected to the outer cloth covering 12, of the pillow base 11, without their respective fill materials. Alternatively, either one of the neck support or the pillow may be manufactured without a fill material, which is inserted subsequently, and prior to use.

I claim:

1. A three-component, self adjustable pillow, comprising:

a. a base portion having a generally elliptically-shaped cross section, and including a cloth exterior and soft fill interior;

b. a generally rectangularly-shaped cloth attachment piece defining an attachment edge, and a free edge, the attachment edge being connected to the pillow; and, c. a cylindrically-shaped neck support defining a longitudinal portion connected to the attachment piece along the free edge, the neck support providing a cloth exterior and soft fill interior; whereby:

i. the attachment piece is adapted to freely move over part of the said base portion along with the attached neck support, for adjustable positioning by the user;

ii. the soft fill interior of said base portion is adapted to transmit forces of compression by the shoulders inwardly along the said base portion and upwardly to the neck support for supporting the neck of the user;

iii. the head and shoulders of the user are supported by the said base portion, the size of the neck support being sufficient to maintain the head, shoulders and neck of the user reasonably aligned, thus reducing aching, discomfort, stiffness and muscle strain of the neck muscles, wherein the base portion dimensions are about 12"–30" wide and about 20"–40" long, the cloth attachment piece is up to about 6" wide, and the neck support is about 1"–6" in diameter; whereby, d. i. during sleep, the inward forces of compression on the said base portion due to the user's shoulders will produce a corresponding upward force on the neck support, and self adjustment of the components; ii. the neck support provides a freely movable range along the plane or surface of the said base portion from about midway to about, the edge thereof; iii. the atachment piece maintains the neck support portion in contact with the said surface throughout its range of movement, while simultaneaously maintaining the user's head and neck on the said base portion; and, iv. the said neck support throughout its freely movable range may be purposefully adjusted by the user while awake, or may self adjust when the user is asleep, and maintains the user's head and shoulders on the pillow, while enabling the user to adjust the degree of support on the neck when adjusting body position from side to back.

2. The self adjustable pillow of claim 1, which the components comprise an external cover, the soft fill material being insertable into one or more of the components prior to use.

3. The self adjustable pillow of claim 1, in which the pillow base structure is about 12"–30" wide, and about 20"–40" long, the cloth attachment piece is about 1"–6" wide, and the neck support is about 1"–6" in diameter.

4. The self adjustable pillow of claim 1, in which the pillow base structure is about 12"–18" wide, and about 30"–36" in length, the cloth attachment piece is up to about 5" wide, and the neck support is about 1"–4" in diameter.

5. The self adjustable pillow of claim 1, in which the attachment piece and the cloth exteriors of the base portion and the neck support comprise woven materials selected from the class consisting of cotton, polyester, nylon, acrylics, and blends of these materials.

6. The self adjustable pillow of claim 1, in which the soft fill interior materials of the base portion and the neck support are selected from the class consisting of cotton, rice, polyester, nylon, acrylic polymers, fiber fill, loose gauze, down, foam, chip foam, air, liquid, gel, and mixtures thereof.

7. The self adjustable pillow of claim 1, in which the limits of movement of the neck support extend to one edge of the base portion.

8. The self adjustable pillow of claim 1, in which the cloth attachment piece is connected to the base portion and to the neck support by sewing.

* * * * *